US006644102B2

(12) United States Patent
Cameron

(10) Patent No.: US 6,644,102 B2
(45) Date of Patent: Nov. 11, 2003

(54) GOLF CLUB FIXTURE

(75) Inventor: Donald T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/051,058

(22) Filed: Jan. 22, 2002

(65) Prior Publication Data

US 2002/0123383 A1 Sep. 5, 2002

Related U.S. Application Data

(60) Provisional application No. 60/263,708, filed on Nov. 25, 2001.

(51) Int. Cl.[7] ..... G01M 1/00

(52) U.S. Cl. ..... 73/65.01; 73/65.03; 33/508; 33/533; 33/534; 33/535; 33/536; 33/537; 33/538

(58) Field of Search ..... 73/65.01, 65.03; 33/501, 508, 533–538

(56) References Cited

U.S. PATENT DOCUMENTS

| | | | | | |
|---|---|---|---|---|---|
| 3,439,429 | A | | 4/1969 | Sundstrom | 33/174 |
| 3,631,602 | A | * | 1/1972 | Noel | 33/508 |
| 3,822,477 | A | | 7/1974 | Collins | 33/174 F |
| 4,094,072 | A | | 6/1978 | Erb | 33/174 |
| 4,245,392 | A | * | 1/1981 | Heller | 33/508 |
| 4,620,431 | A | | 11/1986 | Muldoon | 72/31 |
| 4,640,017 | A | | 2/1987 | Cukon | 33/508 |
| D306,979 | S | | 4/1990 | Cukon | D10/46 |
| D316,660 | S | | 5/1991 | Cukon | D8/71 |
| D324,897 | S | | 3/1992 | Colucci | D21/234 |
| D340,653 | S | | 10/1993 | Cukon | D10/65 |
| 5,421,098 | A | | 6/1995 | Muldoon | 33/508 |
| D376,112 | S | | 12/1996 | Cukon | D10/65 |
| 5,884,409 | A | | 3/1999 | Muldoon | 33/508 |
| 6,250,168 | B1 | * | 6/2001 | D'Aguanno | 73/865.3 |
| 6,363,620 | B1 | * | 4/2002 | Goodjohn | 33/508 |

OTHER PUBLICATIONS

Golf Equipment Universal Catalogue 2000, p. 577.
Mitchell Golf Equipment Company, 2001 Catalog, Golf Club Assembly, Fitting & Repair Equipment, pp. 12–17.

* cited by examiner

*Primary Examiner*—Edward Lefkowitz
*Assistant Examiner*—Alandra Ellington
(74) *Attorney, Agent, or Firm*—Swidler Berlin Shereff Friedman, LLP

(57) ABSTRACT

A device for measuring alignment of a golf club is provided, and allows measurement of the lie angle and loft angle simultaneously. The strike face of the club is placed against an abutment member that is fixed to a base member, and held in place with a clamping member. An alignment member is coupled to the base member and spaced from the clamping member in generally opposing relation thereto. The alignment member is movable with respect to the clamping member to receive the golf club shaft in a cradle.

18 Claims, 10 Drawing Sheets

GOLF CLUB FIXTURE

CROSS-REFERENCE TO RELATED APPLICATIONS

This application claims priority from Provisional Patent Application No. 60/263,708, filed Jan. 25, 2001, the disclosure of which is incorporated herein in its entirety.

FIELD OF INVENTION

The present invention is generally related to golf clubs. In particular, the present invention is related to a device to determine and adjust the loft angle and lie angle of a golf club.

BACKGROUND OF THE INVENTION

Technological innovations and a greater understanding of golf swing dynamics have allowed golf club manufacturers to provide a significant level of customization to match golf clubs to a particular golfer according to the golfer's height and preferred stance. Various golf club design parameters may be customized, such as an adjustment of the angular relationship of the golf club head with respect to the shaft and the ground. Such a customization is useful, for example, because when two golfers with id dissimilar heights address a golf ball using the same club, the angle formed by the shaft of the club with respect to the ground will invariably be different for each golfer. Similarly, depending on the golfer's stance and playing characteristics, the angle formed by the club face of the golf club will also vary among golfers. Thus, to improve a golfer's performance with a particular club, these are two parameters of the club regarding the relative position of the golf club head to the shaft that are often customized to fit the golfer.

Referring now to FIG. 1, a pair of lines 20, 22 represent the plane of the ground. The first example stated above concerns the golf club's lie angle, which is defined as the angle, $\alpha$, formed between a center line 24 extending through the shaft with the ground line 20 as shown tangent to the sole at the centerline of the club face. To accurately obtained the lie angle $\alpha$ of the golf club, the sole of the club head should be resting at the point just below the center of the club face. Proper lie angle is important to ensure that the golf club makes a square contact with the ball during the execution of a swing. For example, if the lie is less than ideal, the sole of the golf club will most likely be upwardly angled when the club head impacts the ball. As a result, the face of the club head will be aimed to the left of the medial line of the fairway, resulting in a left-of-center flight path. On the other hand, if the lie is greater than ideal, the club's sole will likely be downwardly angled at the point of impact and the opposite effect will be obtained.

The other parameter of the golf club head relative to the shaft is the loft angle, shown as $\beta$ in FIG. 1. The loft angle $\beta$ is generally defined as the angle of the backward slant of the face of a golf club head. More particularly, the loft angle $\beta$ is the angle formed by a line 26 perpendicular to the club face to the ground line 22. The greater the loft angle, the greater the loft of ball after being struck by the golf club.

The measurements of the loft angle, for example, may not be indicative of the performance of the club when used by a particular golfer because the physiological and swing characteristics of the golfer can effect the resultant flight of the ball. Accordingly, in providing a more customized set of clubs for a particular golfer, the loft angle is often personalized to meet the particular physical traits and abilities of the individual golfer.

Moreover, as golfers rely on a golf club having a particular loft and lie angle to perform in a particular fashion, any variation based on use or manufacturing tolerance may be quite undesirable, especially for golfers playing at the professional level. Thus, minor adjustments to the loft and lie are often made to the golf clubs used by professional golfers. Such adjustments are typically required at tournaments, on tour, or at various locations remote from manufacturers. Accordingly, there is a need for a golf club adjustment device that is compact and transportable, while easy to use.

In addition, due to the mass production of golf clubs, fine tuning of each golf club by adjusting the loft and lie of the club is often desirable before the clubs are ready for shipment. Thus, manufacturers often make final adjusts to the loft and lie of the clubs after assembly of the club. Such an operation is highly labor intensive and there is a need for a device that permits adjustments to be made quickly and simply.

Finally, technological innovations have allowed manufacturers to produce golf clubs having various configurations that are designed to meet different performance criteria. Thus, there is a need for a device for measuring and adjusting the loft and lie of a golf club should be configured and adaptable to receive and securely hold golf clubs having varied club head configurations.

SUMMARY OF THE INVENTION

The present invention is directed to a device for measuring alignment of a golf club with a shaft and a head having a strike face and a back face. The golf club may be a putter. The device includes a base member and an abutment member fixed to the base member for abutting the strike face. The device further includes at least one clamping member for abutting the back face, with the at least one clamping member being disposed on the base member and spaced from the abutment member to fix the golf club head in a first direction between the at least one clamping member and the abutment member. The device also includes an alignment member coupled to the base member and spaced from the at least one clamping member in generally opposing relation thereto, with the alignment member being movable with respect to the clamping member to receive the golf club shaft in a second direction. The positioning of the alignment member simultaneously indicates the loft angle and lie angle of the golf club.

In one embodiment, the alignment member is slidably and pivotably mounted, and includes a first indicator for indicating lie and a second indicator for indicating loft. The indicator includes a fixed scale and a movable needle, with the needle being coupled to a cradle for receiving said shaft. The second indicator comprises a movable scale and a fixed needle. The base member may further include at least two leveling bearings for abutting a sole of the head. The alignment member is slidable in a direction generally transverse to the clamping member and pivotable in a direction generally parallel to the clamping member. In addition, the alignment member is slidable in a direction generally parallel to the clamping member.

An adjusting bar may also be provided and includes two protrusions, with the protrusions defining a slot therebetween to receive and contour the shaft. According to one aspect of the invention, each of the protrusions is a wheel rotatably secured to the adjusting bar and having a diameter greater than about 0.1 inches, but less than about 0.25 inches. In one embodiment, the diameter is about ⅜ inch, while the slot is between about 1 to 4 inches, and can be about 2.5 inches.

The present invention is also directed to a fixture for retaining a golf club with a shaft and a head having a strike face. The fixture includes a base plate having a top surface, a reference surface fixed to the base plate, and a clamp assembly coupled to the base plate in spaced relation and generally perpendicular to the reference surface. A carriage is coupled to the base, and a measurement member is disposed in a plane generally perpendicular to the top surface. The measurement member is coupled to the carriage in spaced and opposing relation to the clamp assembly, with the measurement member including a cradle that is rotatably coupled to the measurement member and movable with respect to the clamp assembly to receive the golf club shaft. Retention of the club between the reference surface and the clamp assembly with the strike face abutting the reference surface permits the measurement member to simultaneously indicate a loft angle and a lie angle of the golf club. The measurement member is pivotably coupled to the carriage in a plane generally perpendicular to the top surface, while the carriage is movable in a direction generally transverse to the clamp assembly and in a direction generally parallel to the clamp assembly.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
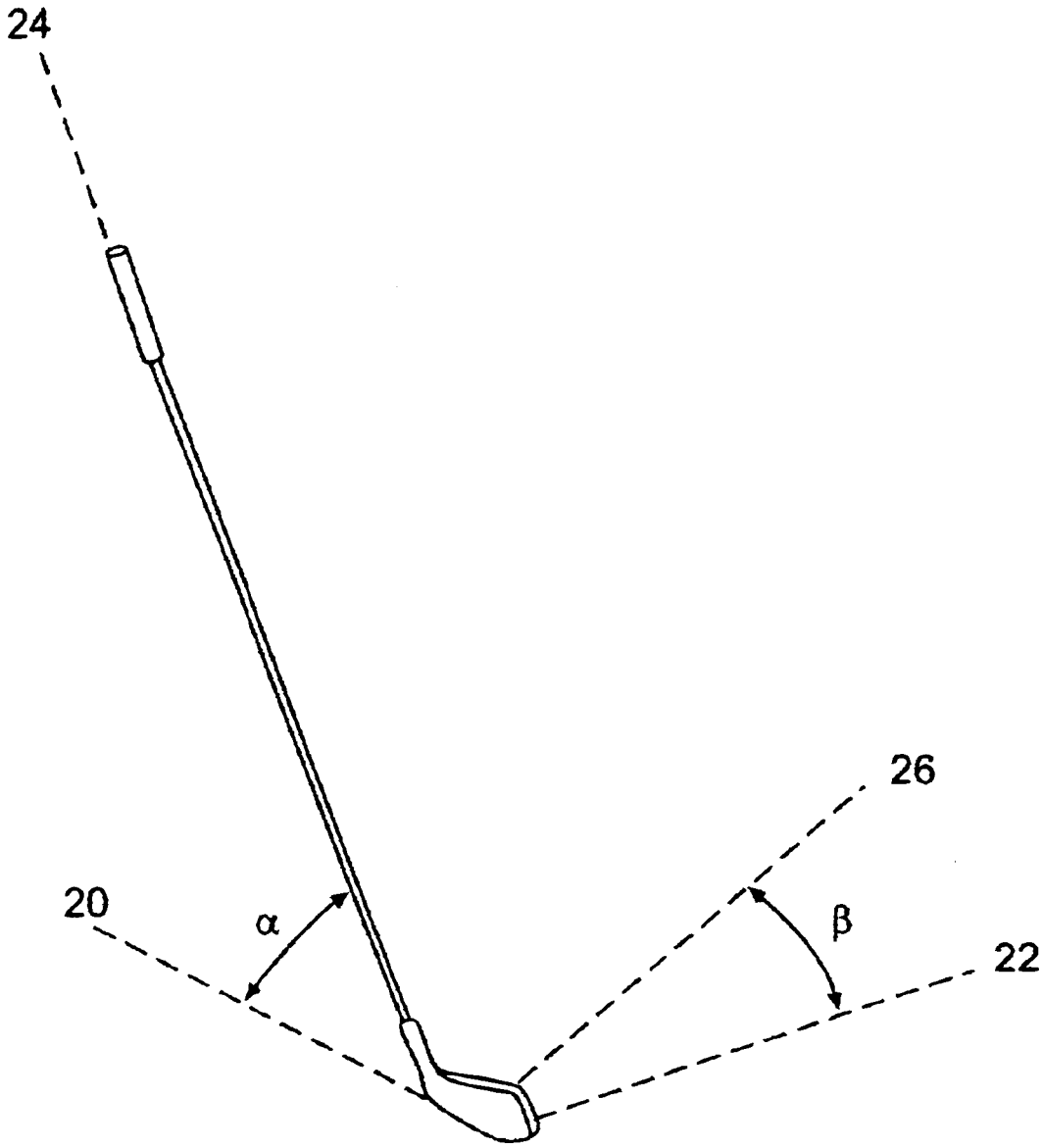
FIG. 1 PRIOR ART
FIG. 1 is a perspective view of a golf club showing the club loft and lie angles.
Figure 2:
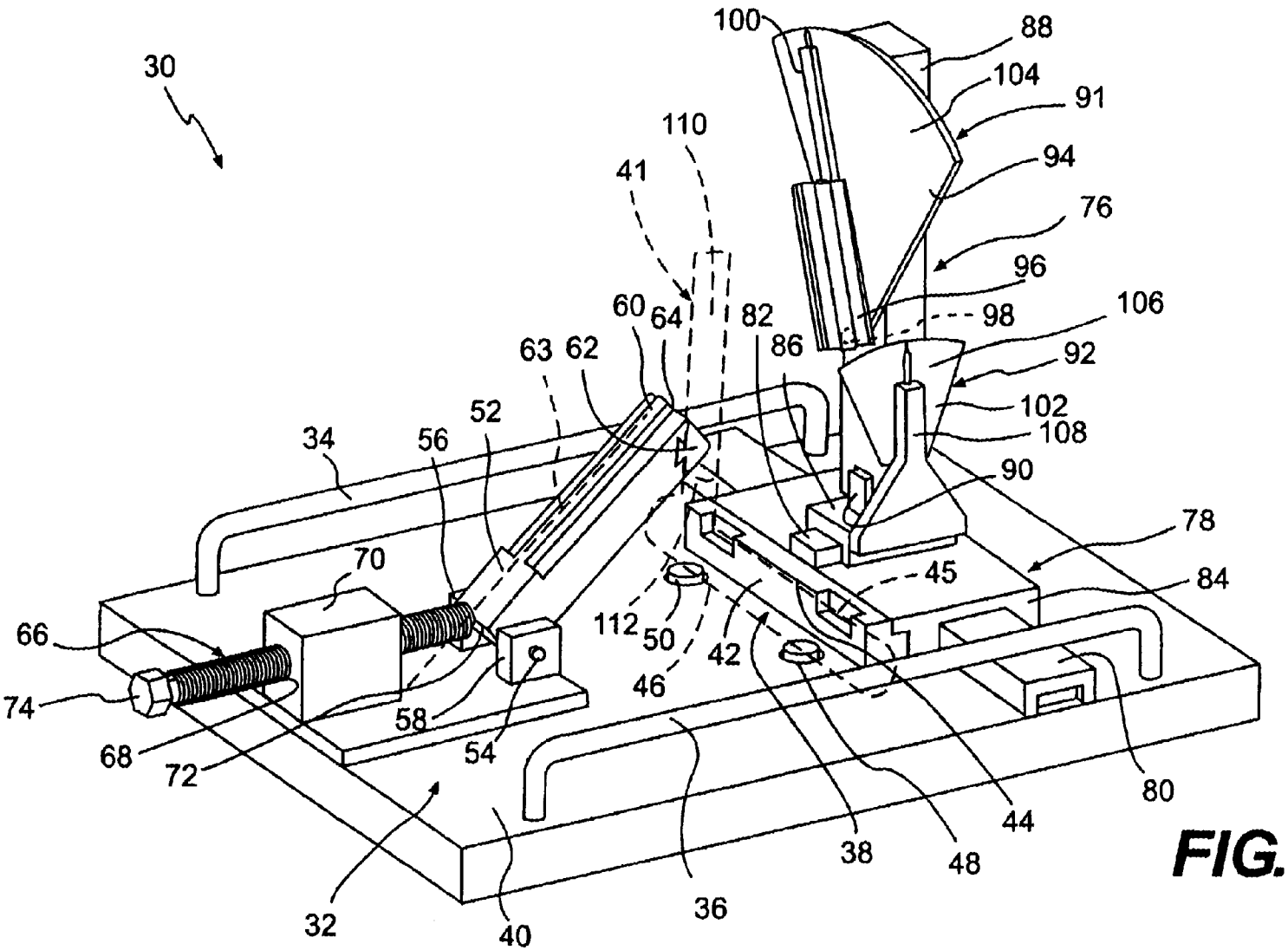
FIG. 2 is a right side, perspective view of a fixture according to the present invention with a putter shown therewith.
Figure 3:
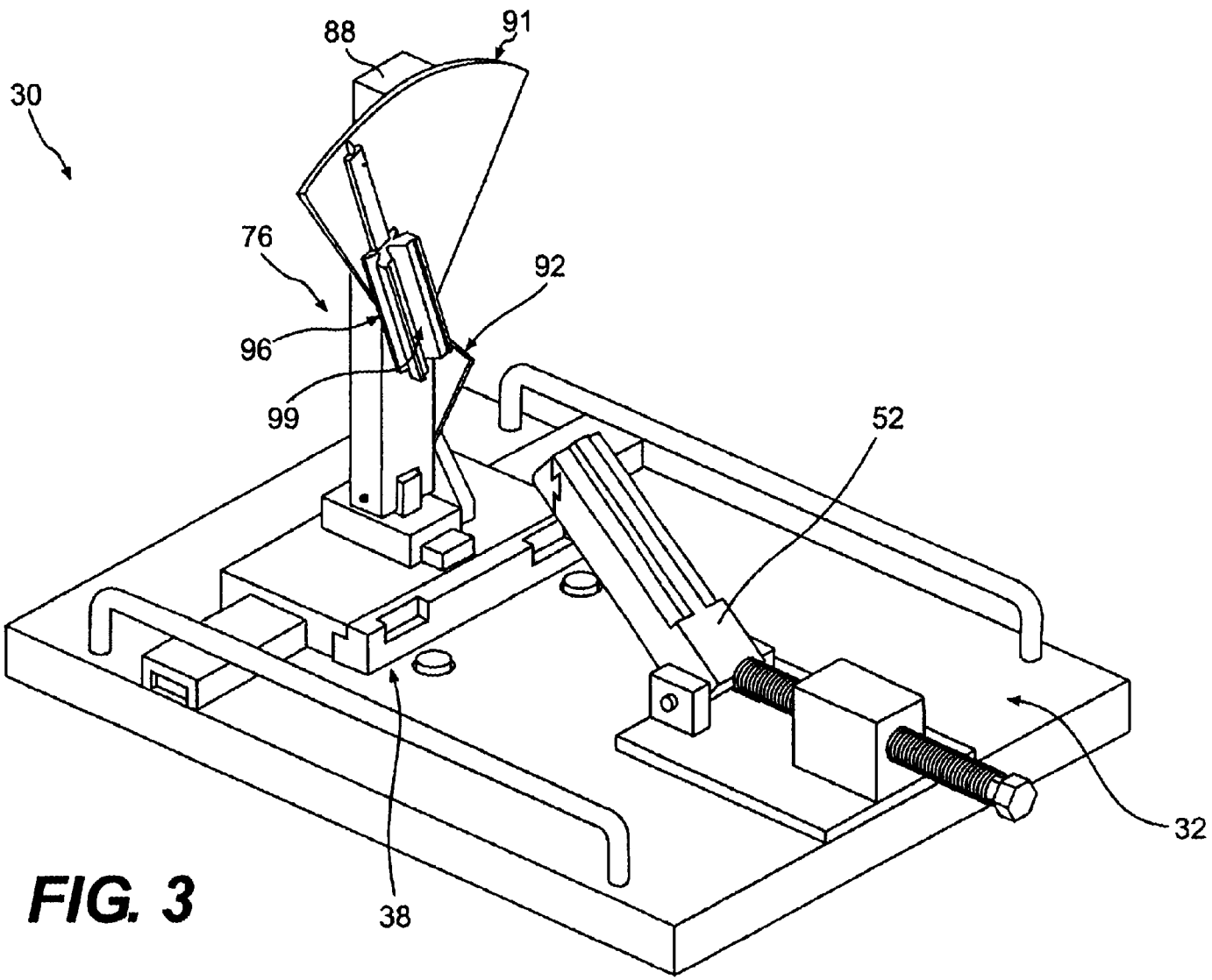
FIG. 3 is a left side, perspective view of the fixture of FIG. 2.
Figure 4:
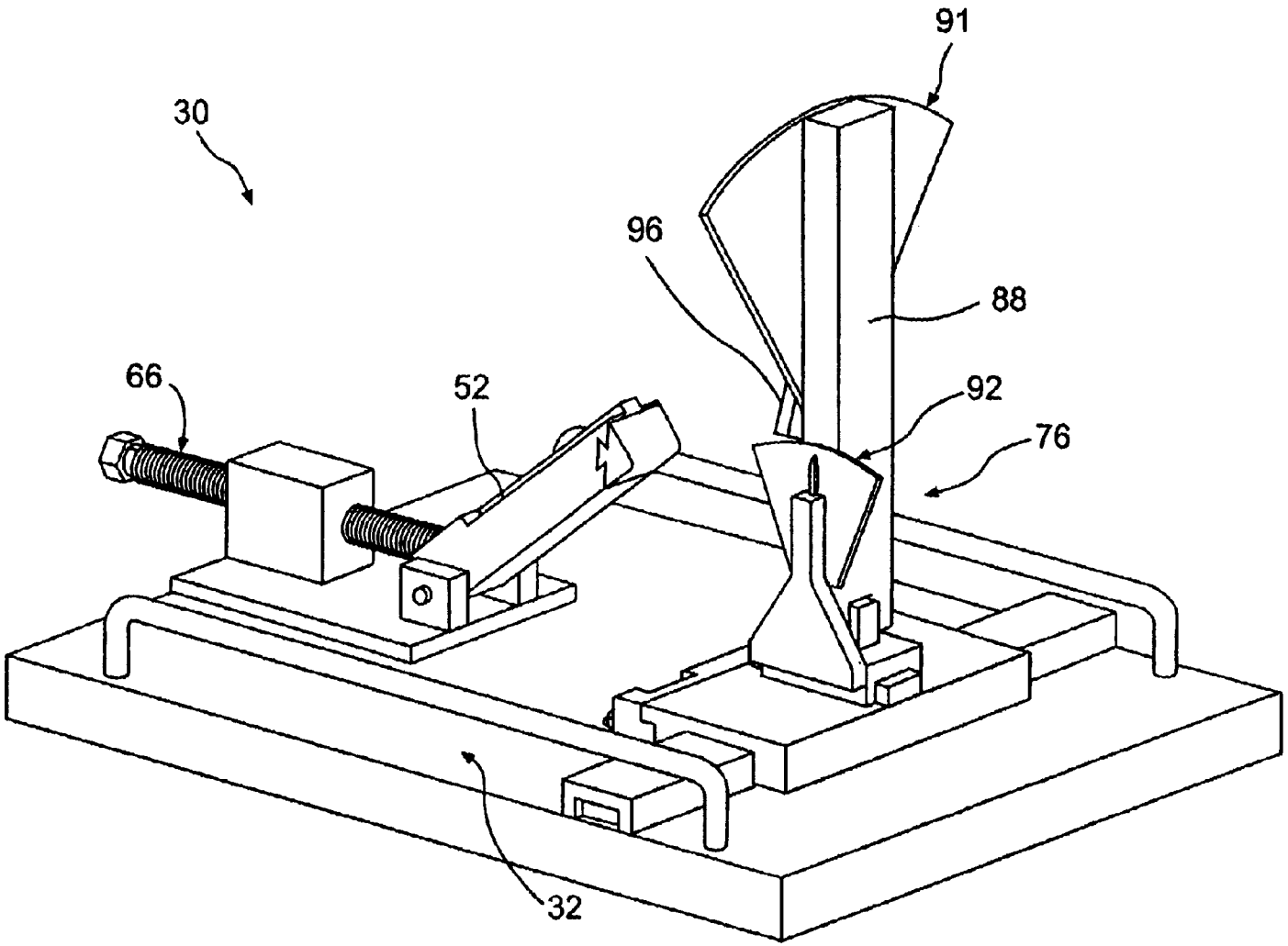
FIG. 4 is a rear, perspective view of the fixture of FIG. 2.
Figure 5:
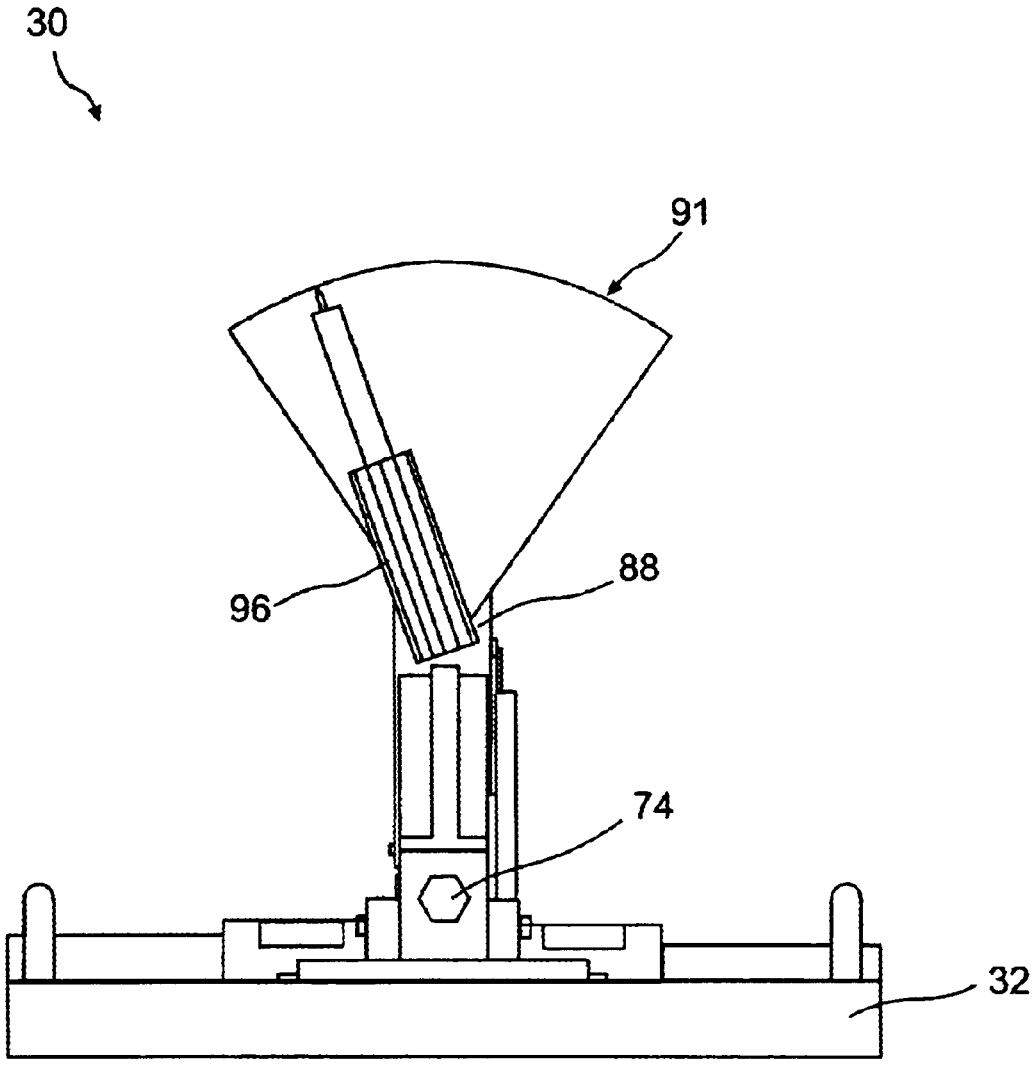
FIG. 5 is a front view of the fixture of FIG. 2.
Figure 6:
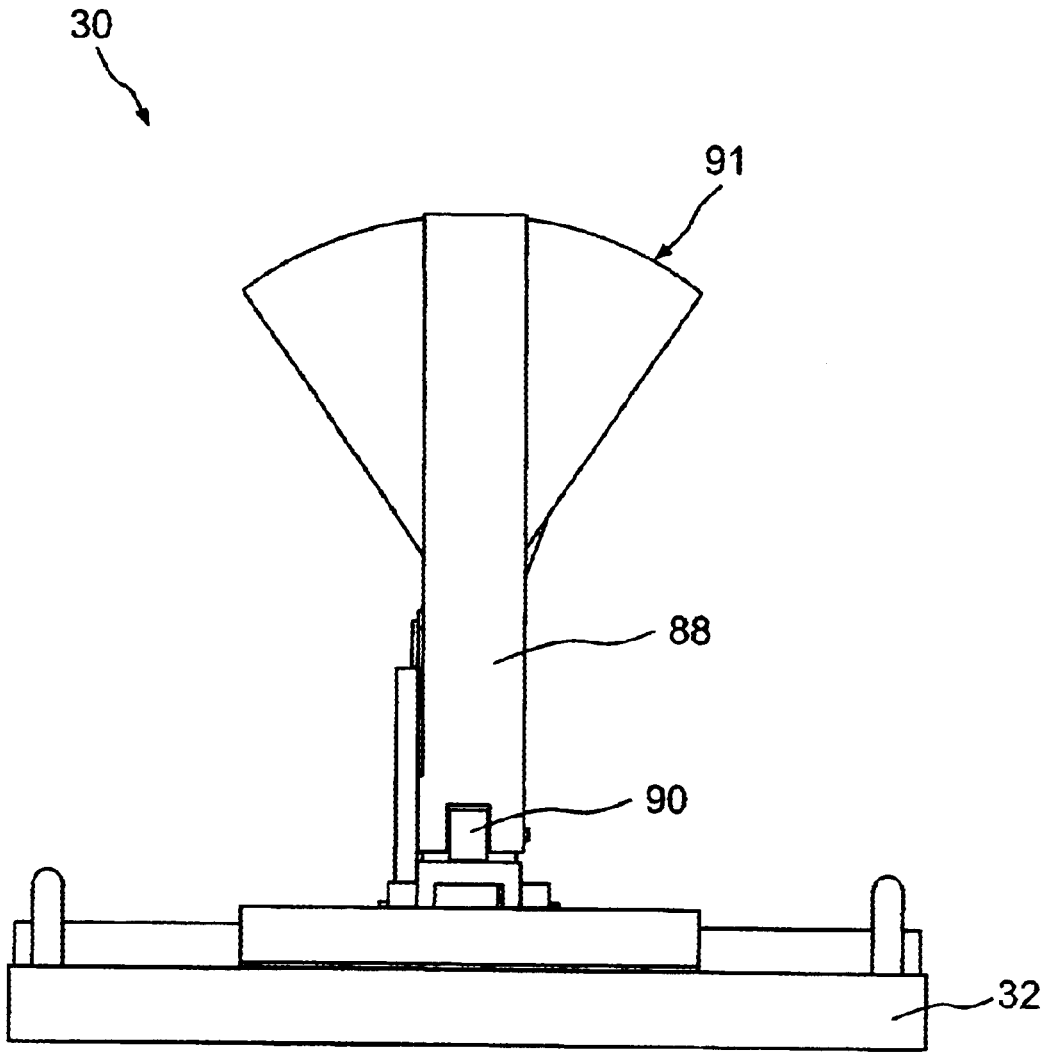
FIG. 6 is a back view of the fixture of FIG. 2.
Figure 7:
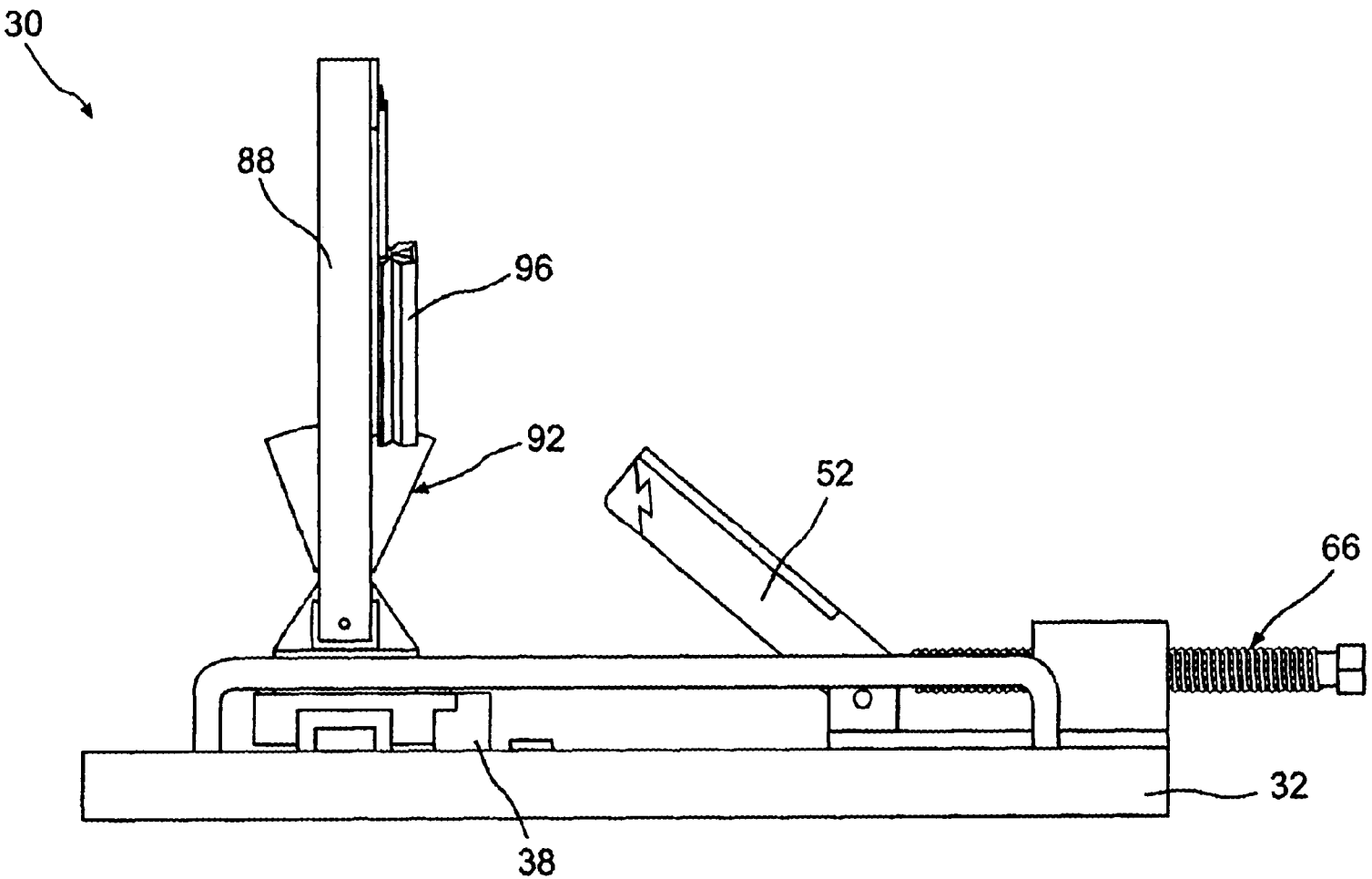
FIG. 7 is a left side view of the fixture of FIG. 2.
Figure 8:
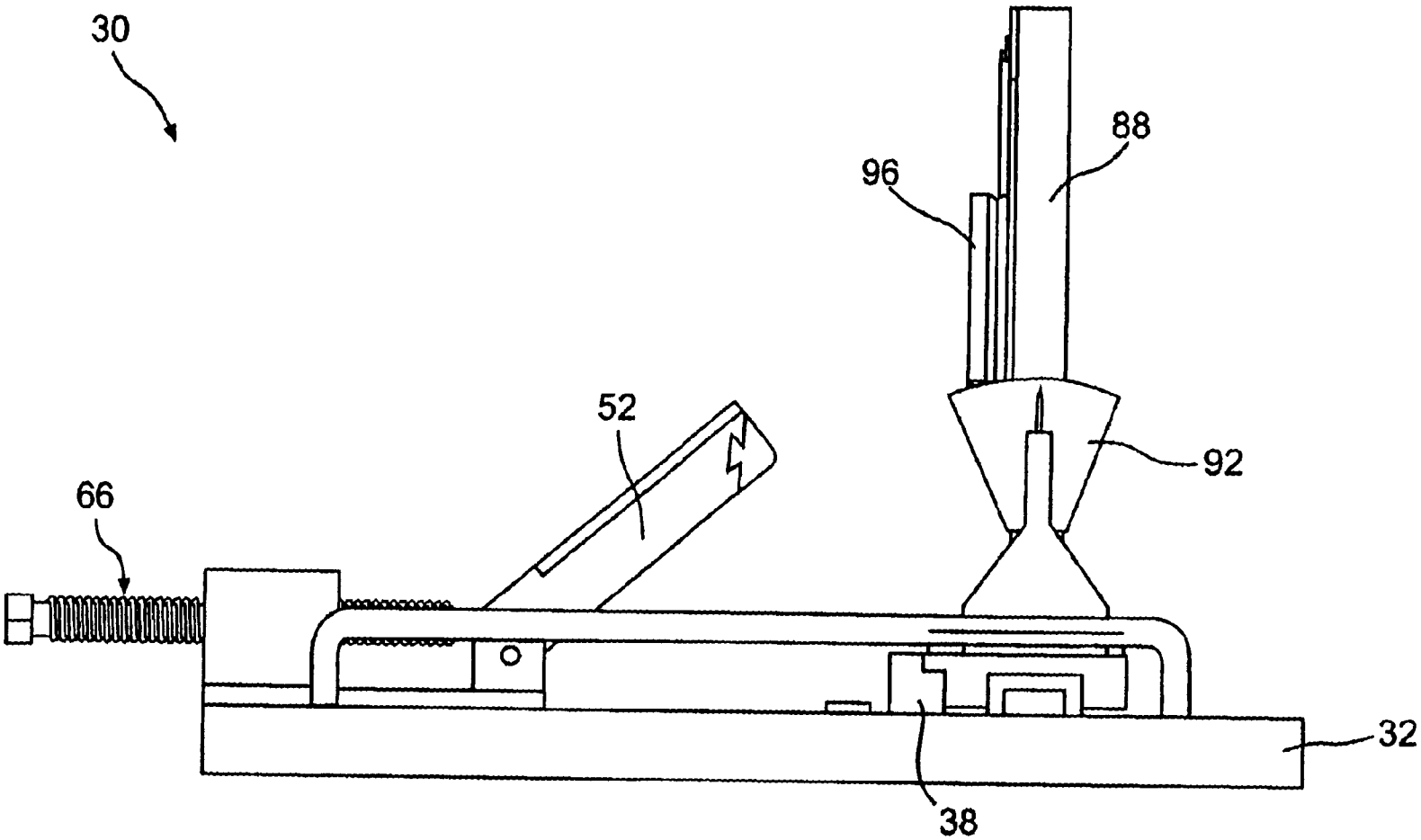
FIG. 8 is a right side view of the fixture of FIG. 2.

Referring to FIGS. 2–10, a device for fixing golf clubs is shown. As shown in particular in FIG. 2, golf club fixture 30 includes a base member 32 and handles 34, 36 so that fixture 30 may be easily transported to various locations. If desired, various clamping devices, such as C-clamps, may be placed about the periphery of base member 32 to secure fixture 30 to a working surface. An abutment 38 is disposed on base member 32 perpendicular to top surface 40 for anchoring a club head in a predetermined position on fixture 30. The strike face of a golf club, preferably a putter 41, is placed against surface 42. While use of fixture 30 is described herein with reference to a putter 41, other geometries of clubs are contemplated for use with the present invention. In the case of a putter with a face having an upper straight edge 45 that is parallel to the sole 46, the straight edge is preferably aligned parallel to leading edge 44 of abutment 38, which is also parallel to top surface 40. The sole 46 of putter 41 rests on a pair of leveling bearings 48, 50, as will be described shortly.

A clamping member 52 is pivotably mounted about a pin 54 retained between opposing supports 56, 58. Clamping member 52 includes a forward portion 60 with a resilient front 62. Preferably, resilient front 62 is formed of a slightly deformable rubber or other polymer that can be compressed upon contact with the back face of putter 41. During use of fixture 30, clamping member 52 is pivoted about pin 54 such that the leading face 64 of clamping member 52 is generally parallel to surface 42 and the central alignment axis 63 of clamping member 52 is generally perpendicular to surface 42. A clamping screw 66 is threadbly associated with a hole 68 in block 70, and clamping screw 66 may be used to exert a force against back face 72 of clamping member 52 so that the strike face of putter 41 is firmly held against surface 42 of abutment 38. To facilitate turning of clamping screw 66, a hex head 74 or other means, such as a lever, may be provided.

An alignment member 76 is coupled to base member 32, and includes a carriage portion 78 for generally aligning the alignment member 76 with respect to putter 41. In the preferred embodiment, carriage portion 78 includes first and second rails 80, 82, respectively, and their associated rigs 84, 86. First rail 80 slides on rig 84, which is oriented substantially parallel to surface 42 of abutment 38. Second rail 82 slides on rig 86, which is oriented substantially perpendicular to surface 42. Thus, alignment member 76 may be positioned along top surface 40 of base member 32. Alignment member 76 includes a post 88 that is pivotably mounted to a block 90 for movement in a plane perpendicular to surface 42.

A lie angle indicator 91 and a loft angle indicator 92 are provided, and in the preferred embodiment are disposed perpendicular to each other. Lie angle indicator 91 includes a scale portion 94, which preferably has calibrated indicia for displaying changes in angular increments. Scale 94 is fixed with respect to post 88. A cradle 96 is pivotably mounted about a pin 98 (for left/right motion), and includes an upper, needle portion 100. Loft angle indicator 92 includes a scale portion 102, also including calibrated angular indicia, and scale portion 102 is fixed with respect to post 88 (for front/back motion). Surfaces 104, 106 of indicators 91, 92, respectively, are perpendicular to each other. Loft angle indicator 92 also includes a needle portion 108, which is fixed to rig 86. Cradle 96 may be provided with one or more grooved regions 99, shown for example in FIG. 3, for accommodating the shaft of the club as will be explained. In one embodiment, three parallel grooves are provided to particularly accommodate left-handed (right side of cradle), right-handed (left side of cradle), and neutrally disposed shafts.

During use of fixture 30, a putter 41 is locked in place against surface 42 of abutment 38 so that the strike face of the putter abuts surface 42. Alignment member 76 is positioned with carriage portion 78 and pivoted with respect to block 90, and cradle 96 is pivoted about pin 98, so that the shaft 110 of putter 41 rests within and against cradle 96, which is centrally aligned with respect to needle 100. Because hosel portion 112 of putter 41 is milled at a 90° angle with respect to the sole 46, true readings of the loft and lie of the club may be obtained using fixture 30. With shaft 110 abutting cradle 96, which has been pivoted to receive shaft 110 concurrently with the pivoting of needle 100, the lie angle may be read from calibrated and preset scale portion 94, as indicated by needle 100. Likewise, in this position with shaft 110 resting in cradle 96, post 88 is pivoted and the loft angle may be read from calibrated and preset scale portion 102, as indicated by needle 108.

Figure 9:
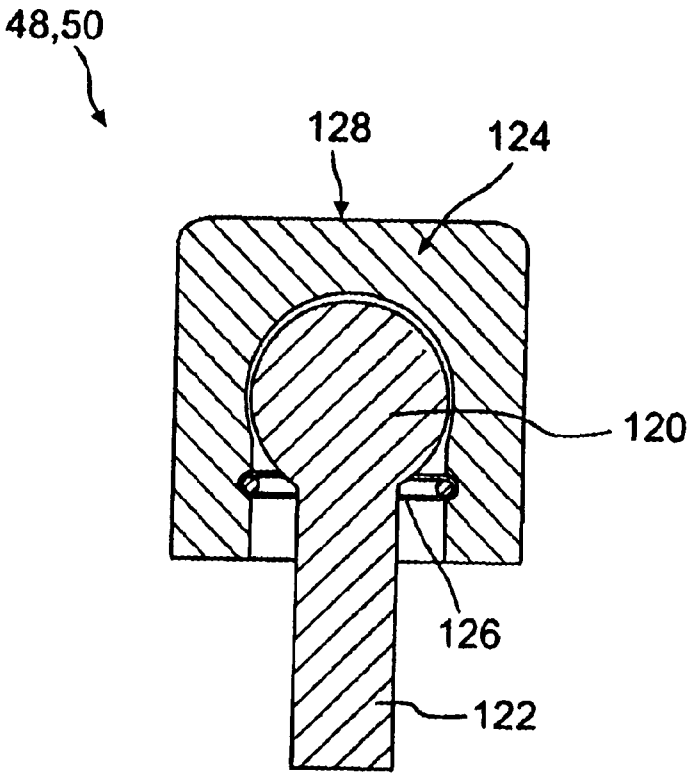
FIG. 9 is a partial cross-sectional view of a leveling bearing of the fixture of FIG. 2.

With reference to FIG. 9, leveling bearings 48, 50 include a spherical ball 120 disposed on a post 122, and a cap 124 disposed on ball 120. A mechanical interlock 126 prevents removal of cap 124 from ball 120. When a putter sole 46 rests on upper surface 128 of a bearing 48, 50, the cap 124 swivels on ball 120. This motion permits the squaring of the putter strike face while accommodating variations in the geometry of sole 46, thereby allowing sole 46 to be supported over a greater surface area.

Figure 10:
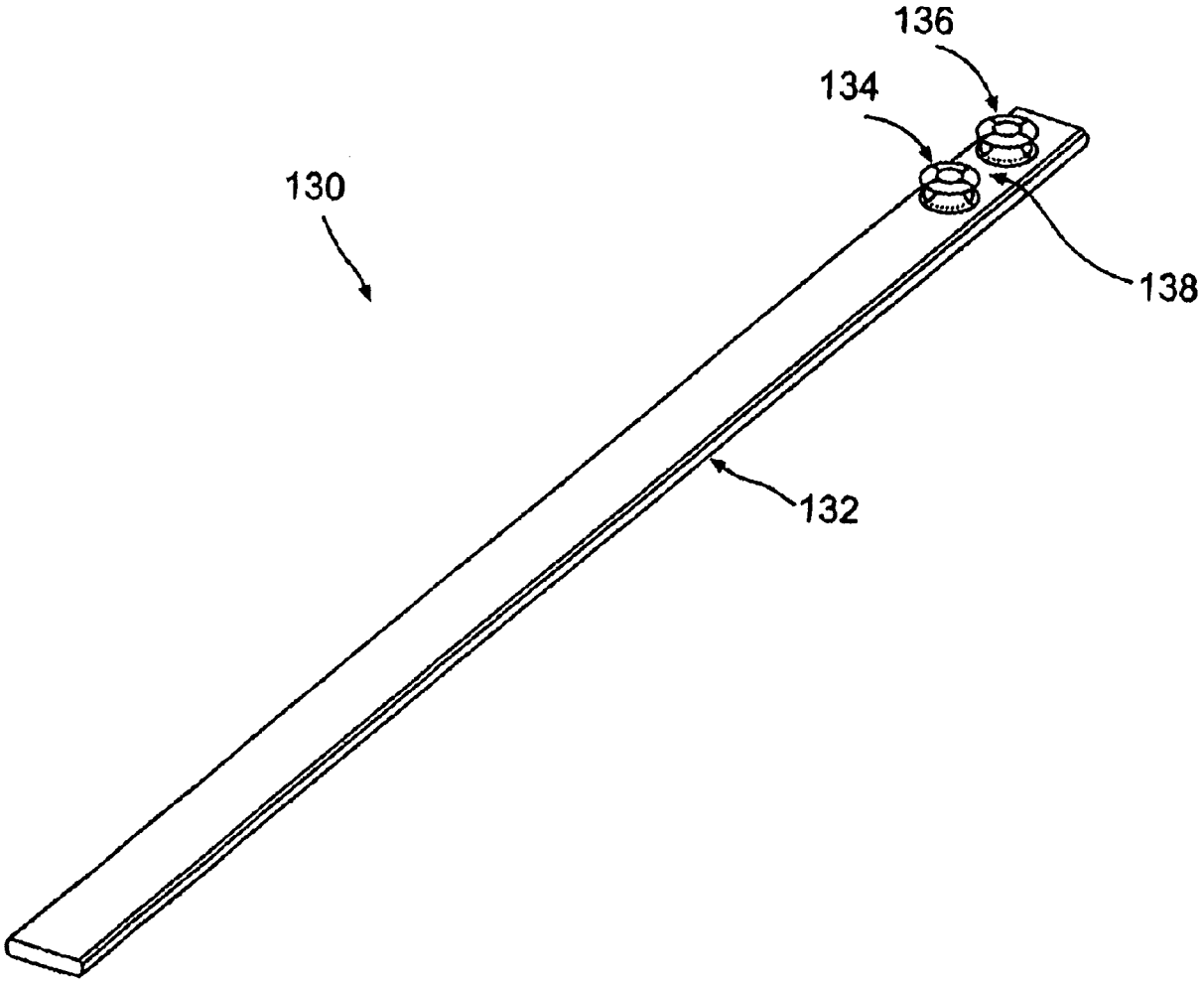
FIG. 10 is an adjusting bar according to the present invention.

Turning to FIG. 10, an adjusting bar 130 is provided for bending the shaft 110 of putter 41 so that desired lie angle can be achieved. If measurement of the lie angle using fixture 30 indicates that an undesired lie angle is set for putter 41, adjusting bar 130 may be used to change the lie angle, which may then be verified using fixture 30. Adjusting bar 130 includes a bar 132 with two protrusions 134, 136 disposed thereon. The protrusions define a slot 138 therebetween, which receives a putter shaft for contouring to the desired lie angle. Preferably, each of the protrusions is a wheel that is rotatably secured to bar 132 and have a diameter greater than about 0.1 inches and less than about 0.25 inches. More preferably, the diameter of protrusions 134, 136 is about ⅜ inch. In the preferred embodiment, slot 138 is between about 1 to 4 inches, and more preferably about 2.5 inches. Typically, shaft 110 is held to the head of putter 41 with epoxy. Protrusions 134, 136 are radiused to match the diameter of shaft 110. Thus, during bending of shaft 110, the creation of stress points due to the bending motion can be minimized. Preferably bar 132 is sufficiently long to provide leverage for a user, and may be about 24 inches in overall length.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, digital readouts of the scales may be provided using electronic sensors, instead of scales with mechanical needles. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A device for measuring alignment of a golf club with a shaft and a head having a strike face and a back face, said device comprising:

a. a base member;

b. an abutment member fixed to said base member for abutting said strike face;

c. at least one clamping member for abutting said back face, said at least one clamping member being disposed on said base member and spaced from said abutment member to fix said golf club head in a first direction between said at least one clamping member and said abutment member;

d. an alignment member coupled to said base member and spaced from said at least one clamping member in generally opposing relation thereto, said alignment member being movable with respect to said clamping member to receive said golf club shaft in a second direction, wherein the positioning of said alignment member simultaneously indicates the loft angle and lie angle of the golf club.

2. The device of claim 1, wherein said alignment member is slidably and pivotably mounted.

3. The device of claim 2, wherein said alignment member comprises a first indicator for indicating lie and a second indicator for indicating loft.

4. The device of claim 3, wherein said first indicator comprises a fixed scale and a movable needle, said needle being coupled to a cradle for receiving said shaft.

5. The device of claim 4, wherein said second indicator comprises a movable scale and a fixed needle.

6. The device of claim 1, wherein said base member further comprises at least two leveling bearings for abutting a sole of said head.

7. The device of claim 2, wherein said alignment member is slidable in a direction generally transverse to said clamping member and pivotable in a direction generally parallel to said clamping member.

8. The device of claim 7, wherein said alignment member is slidable in a direction generally parallel to said clamping member.

9. The device of claim 1, further comprising an adjusting bar having two protrusions, said protrusions defining a slot therebetween to receive and contour said shaft.

10. The device of claim 9, wherein each of said protrusions is a wheel rotatably secured to said adjusting bar and each of said protrusions has a diameter greater than about 0.1 inches.

11. The device of claim 10, wherein said diameter is less than about 0.25 inches.

12. The device of claim 10, wherein said diameter is about ⅜ inch.

13. The device of claim 9, wherein said slot is between about 1 to 4 inches.

14. The device of claim 13, wherein said slot is about 2.5 inches.

15. The device of claim 1, wherein said golf club is a putter.

16. A fixture for retaining a golf club with a shaft and a head having a strike face, comprising:

a base plate having a top surface;

a reference surface fixed to said base plate;

a clamp assembly coupled to said base plate in spaced relation and generally perpendicular to said reference surface;

a carriage coupled to said base;

a measurement member disposed in a plane generally perpendicular to said top surface, said measurement member coupled to said carriage in spaced and opposing relation to said clamp assembly, said measurement member comprising a cradle being rotatably coupled to said measurement member and movable with respect to said clamp assembly to receive said golf club shaft, wherein retention of said club between said reference surface and said clamp assembly with said strike face abutting said reference surface permits said measurement member to simultaneously indicate a loft angle and a lie angle of the golf club.

17. The fixture of claim 16, wherein said measurement member is pivotably coupled to said carriage in a plane generally perpendicular to said top surface.

18. The fixture of claim 17, wherein said carriage is movable in a direction generally transverse to said clamp assembly and in a direction generally parallel to said clamp assembly.

* * * * *